United States Patent [19]

Lachance

[11] 4,117,933

[45] Oct. 3, 1978

[54] BOTTLE CARRIER

[76] Inventor: Gilles Lachance, 56 Place Montmorency, Laval, Canada, H7N 1T6

[21] Appl. No.: 829,585

[22] Filed: Aug. 30, 1977

[51] Int. Cl.[2] ..... B65D 85/54

[52] U.S. Cl. ..... 206/583; 224/47; 190/60

[58] Field of Search ..... 224/47, 46 R, 45 AA, 224/45 Q, 45 R; 190/60, 42, 41 R; 150/52 R; 215/12 R; 206/583, 521, 591, 418

[56] References Cited

U.S. PATENT DOCUMENTS

| | | | |
|---|---|---|---|
| 987,162 | 3/1911 | Oglesby et al. | 206/583 |
| 2,335,779 | 11/1943 | Mazzei | 206/583 |
| 2,376,194 | 5/1945 | Samuels | 150/52 R |

FOREIGN PATENT DOCUMENTS

| | | | |
|---|---|---|---|
| 26,505 | 6/1906 | Austria | 190/42 |

*Primary Examiner*—Trygve M. Blix
*Assistant Examiner*—Kenneth W. Noland

[57] ABSTRACT

A bottle carrier for a suitcase comprising a bottle-shaped wrapper having an opening closed by a zipper for insertion and removal of a bottle. The wrapper is suspended across the top and bottom edge portions of the half-portion of a suitcase fitted with a carrying handle. The suspension device includes a shock-absorbing helical spring at the top end of the wrapper and a stabilizing cord at the bottom end of the wrapper. A snap lock serves to detachably attach the wrapper to the helical spring.

3 Claims, 3 Drawing Figures

BOTTLE CARRIER

The present invention relates to a type of bottle carrier specifically a bottle carrier designed for use in a valise, suitcase or travelling bag.

Many people carry bottles of various liquids (especially liquor) when travelling, either for personal consumption or perhaps to give as a present to someone. However, many other people are reluctant to carry bottles in their suitcases for fear of breakage or leakage, which often happens as valises are subject to bumps and shocks in transit. Furthermore, it is not always practical to carry a bottle next to garments or paper if, for example, the bottle contains a cold beverage which might cause the glass sides of the bottle to condense moisture while in the valise.

Accordingly, it is an object of the present invention to provide a shock-resilient bottle carrier adapted for use inside a suitcase.

It is another object of the present invention to provide a bottle carrier whereby bottles are vertically suspended inside an isolating wrapper wherefrom a bottle may be easily inserted and removed.

These objects are accomplished in accordance with a preferred embodiment of the invention, the principal feature of which is a wrapper hung from the roof of a suitcase by a spring means. The wrapper is preferably made of woven material or other equivalent shock-resisting and insulating material and is equipped with a splitting means, such as a zipper to allow easily insertion and removal of a bottle. The bottle carrier and its bottle are further stabilized by a cord, or string, extending from the bottom of the wrapper to the bottom of the suitcase. In this arrangement, the bottle is carried in vertical position at all times, unless, of course, the suitcase itself is not in a vertical position.

The above will be more clearly understood by referral to the preferred embodiment of the invention illustrated by way of the accompanying drawings, in which.

Like numerals refer to like elements throughout the drawings.

Figure 1:
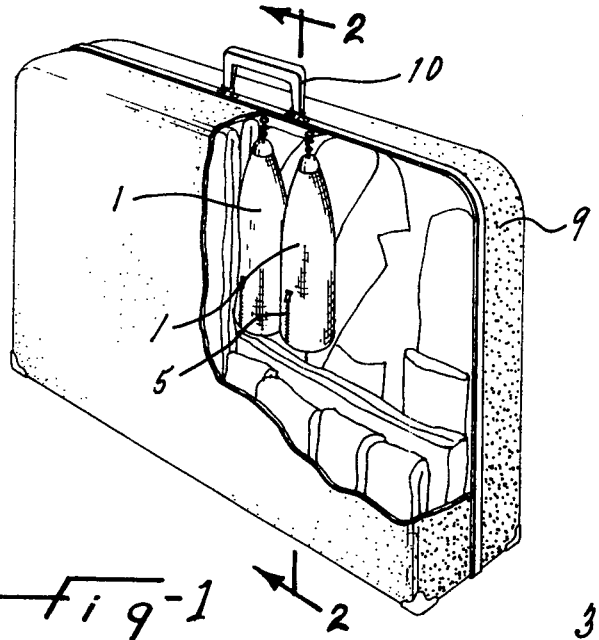
FIG. 1 is a perspective and partially-sectioned view of a suitcase having the bottle carrier.

A bottle-shaped wrapper 1, made of woven fabric or other suitable impact cushioning and heat-insulating material, is provided with a zipper 5 extending down one side from a point at approximately one-third the height of the wrapper and diametrically across the bottom of the wrapper. By undoing the zipper, a bottle may be easily inserted or removed through the opening provided by the zipper. Wrapper 1 is generally bottle-shaped to allow carriage of many different kinds of bottles. A cap 3 is secured to the top of wrapper 1. Cap 3 is provided with a snap-lock 4, which in turn is hinged on a helical spring 6, or other suitable spring means. The top end of spring 6 is hooked into an eye-bolt 2, or other suitable attaching means. Eye-bolt 2 is preferably attached to the conventional edge frame 7 which is normally fixed to the inside of the suitcase edge strip 8 fixed around the edge of the suitcase half-portion 9 fitted with a carrying handle 10.

Figure 2:
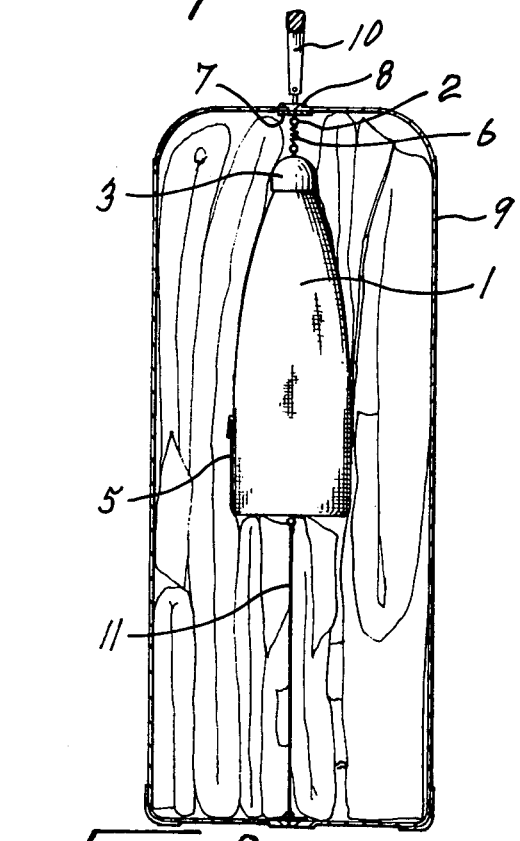
FIG. 2 is a cross-sectional view taken along line 2—2 of FIG. 1.
Figure 3:
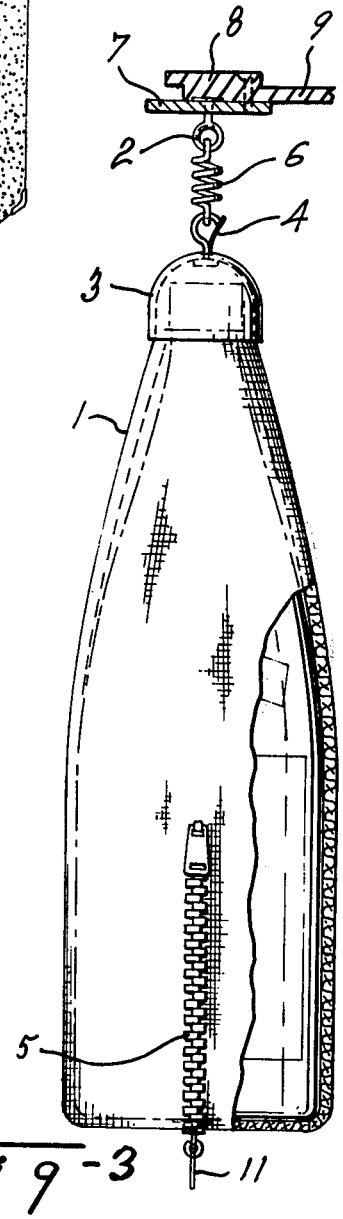
FIG. 3 is a side view of one bottle carrier with a partial section showing a bottle inside.

A cord 11 further stabilizes the bottle carrier. Cord 11 extends from the bottom of wrapper 1 to the bottom of suitcase half-portion 9, shown in FIG. 2. If necessary, cord 8 may be removed, but this is not essential, as removal and insertion of bottles may be accomplished by merely undoing zipper 5 and/or detaching helical spring 6 from snap lock 4.

As shown by FIG. 1, a plurality of bottles may be carried upright and side by side in a suitcase by the present invention, the number depending on space available. Also, the present invention does not hinder unoccupied space permitting the packing of other items, such as garments needed for travelling, and the insulating property of the wrapper would prevent a cold bottle from damaging other articles in the suitcase. These garments further prevent lateral displacement of the bottle carrier in the suitcase.

What I claim is:

1. The combination of a bottle carrier with a suitcase, the latter having a generally rectangular or squared shape body portion defined by a bottom wall and pairs of substantially parallel first and second side walls, with said second side walls being substantially perpendicular to said first side walls, a cover hinged to said body portion along an edge of one of said first side walls, a carrying handle for said suitcase attached to the other of said first side walls, said bottle carrier comprising an elongated generally bottle-shaped wrapper sheath of a material having heat-insulating and shock-protecting properties and having an opening for removal and insertion of a bottle, means for closing said opening, and a shock-absorber resilient attaching means for said wrapper sheath including a helical spring attached at one end to an end of said wrapper sheath, and at the other end to said other one of said first side walls, and a cord attached to the other end of said wrapper sheath and to said one of said first side walls, said wrapper sheath, spring and cord extending along a substantially straight line within said suitcase and in a plane substantially parallel to said cover and bottom wall and extending through said handle, said cord maintained taut by said spring, whereby a bottle inserted in said wrapper sheath may be carried upright inside said suitcase when the latter is upright and said handle uppermost, and is further protected by garments and other items carried in said suitcase and filling the latter around said wrapper sheath and bottle.

2. The combination defined in claim 1, wherein said means for closing said opening include a slide fastener extending down approximately one-third of one side and diametrically across the bottom of said wrapper sheath.

3. The combination as claimed in claim 1, wherein said attaching means further include a snap lock secured to the top of said wrapper sheath and to which said one end of said helical spring is removably attached.

* * * * *